US007598840B2

(12) United States Patent
Lu

(10) Patent No.: US 7,598,840 B2
(45) Date of Patent: Oct. 6, 2009

(54) METAL OXIDE VARISTOR HAVING THERMAL CUT-OFF FUNCTION

(75) Inventor: Chien-Hsun Lu, Taoyuan County (CN)

(73) Assignee: CeNtRa Science (holdings) Ltd, Bai Sha Village, Humen Town, Dongguan (CN)

( * ) Notice: Subject to any disclaimer, the term of this patent is extended or adjusted under 35 U.S.C. 154(b) by 121 days.

(21) Appl. No.: 11/782,124

(22) Filed: Jul. 24, 2007

(65) Prior Publication Data

US 2008/0088404 A1 Apr. 17, 2008

(30) Foreign Application Priority Data

Oct. 13, 2006 (CN) ..... 2006 2 0065544 U

(51) Int. Cl.
*H01C 7/10* (2006.01)

(52) U.S. Cl. ..... 338/20; 338/21; 337/183; 337/184; 361/121; 361/117

(58) Field of Classification Search ..... 338/20, 338/21, 67; 337/4, 142, 183, 184, 290; 361/121, 361/124, 126, 117, 119
See application file for complete search history.

(56) References Cited

U.S. PATENT DOCUMENTS 4,538,347 A * 9/1985 Palilla et al. ..... 29/619
6,094,128 A * 7/2000 Bennett et al. ..... 338/21
6,636,403 B2 * 10/2003 McLoughlin et al. ..... 361/103

* cited by examiner

*Primary Examiner*—Kyung Lee
(74) *Attorney, Agent, or Firm*—Global IP Services; Tianhua Gu

(57) ABSTRACT

A MOV includes a MOV body, a first lead, a thermal cut-off fuse, a second lead and a silver electrode area. The MOV of the present invention employs the silver electrode area formed on and electrically coupled to the MOV body, thus the MOV has a lower inductance, which accordingly, enables the MOV to have a high and sound thermal conductivity. Hence, the MOV can fleetly and perfectly transfer heat to the thermal cut-off fuse in case of over-voltages, thus enabling the thermal cut-off fuse to cut off the power more quickly.

6 Claims, 4 Drawing Sheets

METAL OXIDE VARISTOR HAVING THERMAL CUT-OFF FUNCTION

CROSS REFERENCE TO RELATED PATENT APPLICATION

This application claims the priority of the Chinese patent application No. 200620065544.7, filing date of Oct. 13, 2006.

FIELD OF THE INVENTION

The present invention relates to metal oxide varistors (MOVs) having thermal cut-off function, and more particularly, to MOVs which contain fusible materials which melt before the MOVs begin thermal runaway.

BACKGROUND OF THE INVENTION

MOVs are widely used as electronic components for suppressing surge voltages generated commonly in conventional electronic devices, such as surge absorbers, PTC (positive temperature coefficient) thermistors, NTC (negative temperature coefficient) thermistors and ceramic capacitors. Generally, a typical MOV has non-linear resistance properties in which resistance is high at normal power voltage but disproportionately low at high voltage exceeding predetermined levels.

As is well known, if the MOV has been used for a long time, the original high impedance of the resistance could become low, and a leakage current relative to the MOV may happen. In some worse cases, the leakage state will deteriorate gradually and thus the leak current may finally form a leak point with material thereof being melted and producing a short circuit point of about 1K Ohm. Then, if power source continues to impulse a substantial strong current into the short circuit point, the MOV will be caused to be overheated and caught fire. In addition, thermal energy results from instantaneous over-voltages due to lightning strike, switching of power or the like will make the MOV an increase in the temperature, which also unadvantagely leads to resistance punch or combustion.

One way used to protect the MOV at present is introduction of thermal cut-off fuse which is wired with the MOV and positioned adjacent one face of the MOV. The melting point of the thermal cut-off fuse is at a temperature below what is required to put the MOV in thermal runaway. As the temperature at the face of the MOV rises, a point is reached at which the thermal cut-off fuse melts and opens one lead to the MOV which no longer receives current. However, as it is epoxy and air that serve as the heat transportation medium, and as the epoxy has a limited thermal conductivity and the surrounding air could cool down or substantially influence the heat being transferred to the thermal cut-off fuse, sometimes thermal fuse cuts off the power just after the MOV becomes failed and burns, thus the prior approach can not prevent combustion of MOV efficiently.

Hence, a need has arisen for providing an improved MOV having thermal cut-off function to overcome the above-mentioned disadvantages.

SUMMARY OF THE INVENTION

Accordingly, an object of the present invention is to provide a MOV having thermal cut-off function capable of cutting off power quickly to avoid burning when overheated.

To achieve the above-mentioned object, a MOV having thermal cut-off function according to the present invention comprises a MOV body, a first lead, a thermal cut-off fuse, a second lead and a silver electrode area. The MOV body has a first lateral side and a second lateral side. The MOV body heats up when exposed to voltage strikes. One end of the first lead is electrically coupled to the first lateral side; the other end opposite to the one end of the first lead is adapted to couple to a source of current. The thermal cut-off fuse comprises a first fuse end and a second fuse end. The thermal cut-off fuse has a predetermined melting point at which the thermal cut-off fuse melts and interrupts current flow therethrough. One end of the second lead is electrically coupled to the first fuse end of the thermal cut-off fuse; the other end opposite to the one end of the second lead is adapted to couple to the source of current. One end of the silver electrode area is formed on and electrically coupled to the second lateral side, and the other end opposite the one end of the silver electrode area is electrically coupled to the second fuse end of the thermal cut-off fuse. The current is permitted to flow through the first lead, the MOV body, the silver electrode area, the thermal cut-off fuse and the second lead when the thermal cut-off fuse is held below the predetermined melting point and current is interrupted when the thermal cut-off fuse goes above the predetermined melting point and melts due to the heat provided by the MOV body, under which case the MOV is protected from thermal runway.

As an embodiment of the present invention, the MOV further comprises a coating layer coated around the first lead, the MOV body, the silver electrode area, the thermal cut-off fuse and the second lead so as to form an outer protection layer.

As another embodiment of the present invention, the MOV further comprises a third lead. One end of the third lead is electrically connected to the other end of the silver electrode area, the other end of the third lead is adapted to couple with a visual indicator, and the visual indicator will be activated to monitor circuit connection when the current is interrupted.

Alternatively, the MOV body is circular or square. Also alternatively, the silver electrode area is circular or square.

Preferably, the MOV body and the silver electrode area are concentric and circular or square.

Comparing with the prior art, the MOV of the present invention employs a silver electrode area formed on and electrically coupled to the MOV body, thus the MOV has a lower inductance, and accordingly, enables the MOV to have a high and sound thermal conductivity. Hence, the MOV can fleetly and perfectly transfer heat to the thermal cut-off fuse in case of over-voltages, thus making the thermal cut-off fuse cut off the power more quickly.

Other aspects, features, and advantages of this invention will become apparent from the following detailed description when taken in conjunction with the accompanying drawings, which are a part of this disclosure and which illustrate by way of example, principles of this invention.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
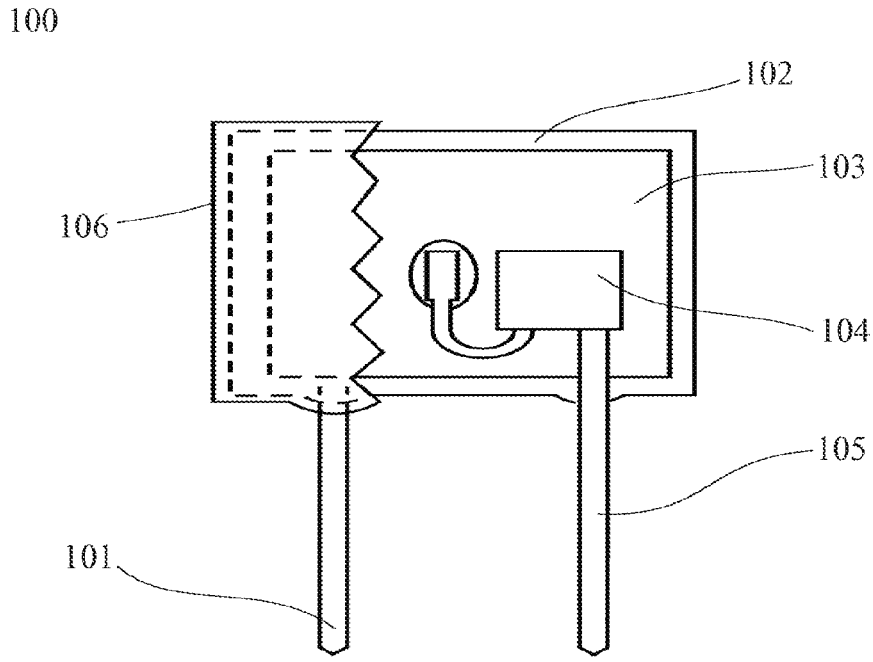
FIG. 1 is a front elevation view of a MOV of a first embodiment according to the present invention, illustrating the internal structure of the MOV.
Figure 2:
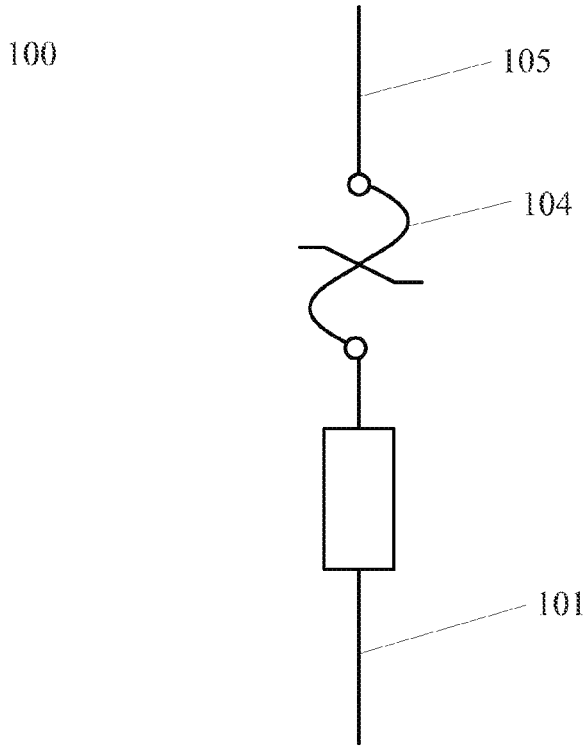
FIG. 2 is a circuit diagram generally showing circuit connection relationships within the MOV of FIG. 1 and FIG. 5.

Various preferred embodiments of the invention will now be described with reference to the figures, wherein like reference numerals designate similar parts throughout the various views. As indicated above, the invention is directed to a MOV having thermal cut-off function. The MOV comprises a MOV body, a first lead, a thermal cut-off fuse, a second lead and a silver electrode area. As the MOV of the present invention employs a silver electrode area formed on and electrically coupled to the MOV body, thus the MOV has a lower inductance, and accordingly, enables the MOV to have a high and sound thermal conductivity. Hence, the MOV can fleetly and perfectly transfer heat to the thermal cut-off fuse in case of over-voltages, thus enabling the thermal cut-off fuse to cut off the power more quickly.

FIGS. 1-4 detailedly describe internal structure and working principle of a MOV 100 of a first embodiment of the present invention. FIG. 1 is a front elevation view of the MOV 100 illustrating the internal structure thereof and FIG. 2 generally shows circuit connection relationships within the MOV 100. Specifically, the MOV 100 comprises a first lead 101, a MOV body 102 having a first lateral side and a second lateral side opposite the first lateral side, a silver electrode area 103, a thermal cut-off fuse 104 having a first fuse end and a second fuse end, a second lead 105 and a coating layer 106. In the embodiment, the MOV body 102 and the silver electrode area 103 are concentric and square.

The first lead 101 is adapted to couple to a source of current at one end, and the other end of the first lead 101 is electrically coupled to the first lateral side of the MOV body 102.

The MOV body 102 is apart to generate, under voltage strikes, an abnormally high current accompanied by excess heat which keeps on raising the temperature of electronic device with the MOV and thus makes the electronic device unstable.

The silver electrode area 103 is formed on and electrically coupled to the second lateral side of the MOV body 102 at one end thereof, and the other end opposite the one end of the silver electrode area 103 is electrically coupled to the second fuse end of the thermal cut-off fuse 104.

The thermal cut-off fuse 104 is thermally and electrically conductive and has a predetermined melting point at which the thermal cut-off fuse melts and interrupts current flow therethrough.

The second lead 105 is electrically coupled to the first fuse end of the thermal cut-off fuse 104 at one end thereof, and the other end opposite to the one end of the second lead 105 is adapted to couple to the source of current.

The coating layer 106 is coated around the first lead 101, the MOV body 102, the silver electrode area 103, the thermal cut-off fuse 104 and the second lead 105 so as to form an outer protection layer.

Figure 3:
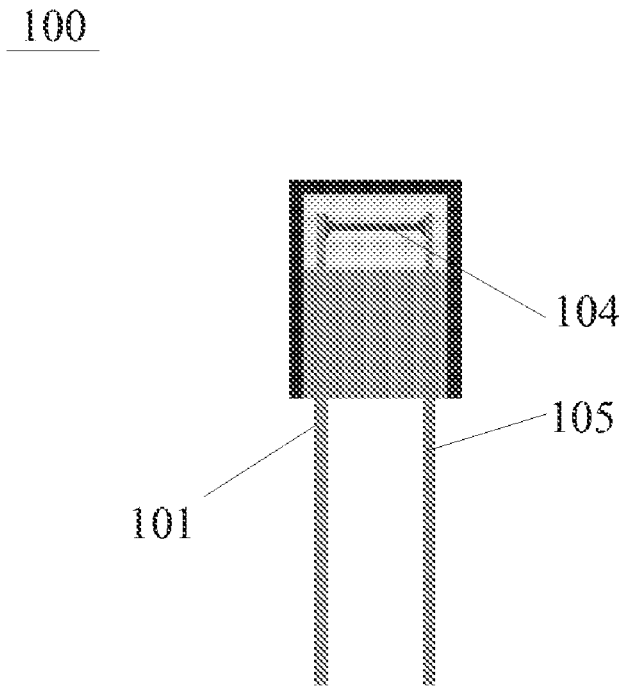
FIG. 3 is a schematic diagram showing the state of the MOV of FIG. 1 before a thermal cut-off fuse melts.
Figure 4:
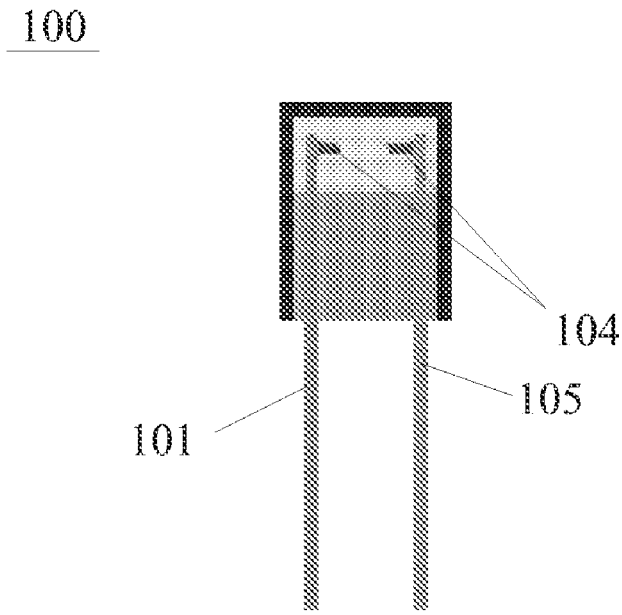
FIG. 4 is a schematic diagram showing the state of the MOV of FIG. 1 after a thermal cut-off fuse melts.

Referring to FIGS. 3-4, the working principles of the MOV 4 is illustrated. As shown in FIG. 3, when the thermal cut-off fuse 104 is held below the predetermined melting point, the current is permitted to flow through the path of the first lead 101, the MOV body 102, the silver electrode area 103, the thermal cut-off fuse 104 and the second lead 105, in which case the MOV 100 keeps at a normal operating state. However, referring to FIG. 4, if the current flowing through this path rises due to lightning strikes, load switching, etc. resulting in the heating of the MOV 100 continuously, the heat will be transfer to the thermal cut-off fuse 104, thus accordingly making the thermal cut-off fuse 104 going above the predetermined melting point. Then the thermal cut-off fuse 104 melts and opens the path to the second lead 105 and the current path within the MOV 100 is interrupted. In such way, the MOV 100 is taken out of the circuit, thus protected from excessive heating and thermal runway.

In the subject embodiment, the silver electrode area 103 makes the MOV 100 have a lower inductance, and accordingly, enables the MOV 100 to have a high and sound thermal conductivity. Thus the MOV 100 can fleetly and perfectly transfer heat to the thermal cut-off fuse 104 in case of over-voltages thus assisting the thermal cut-off fuse 104 to cut off the power more quickly.

Figure 5:
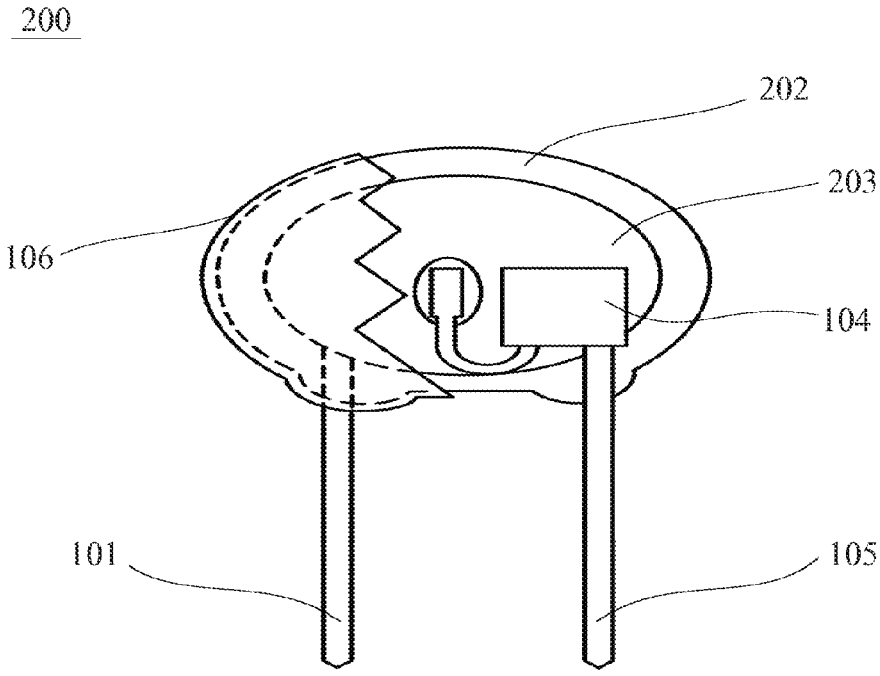
FIG. 5 is a front elevation view of a MOV of a second embodiment according to the present invention.

FIG. 5 is a front elevation view of a MOV 200 of a second embodiment according to the present invention. The MOV 200 comprises a first lead 101, a MOV body 202, a silver electrode area 203, a thermal cut-off fuse 104, a second lead 105 and a coating layer 106. Comparing the MOV 200 with the MOV 100 of the first embodiment, the difference is that the MOV body 202 and the silver electrode area 203 are concentric and circular.

Figure 6:
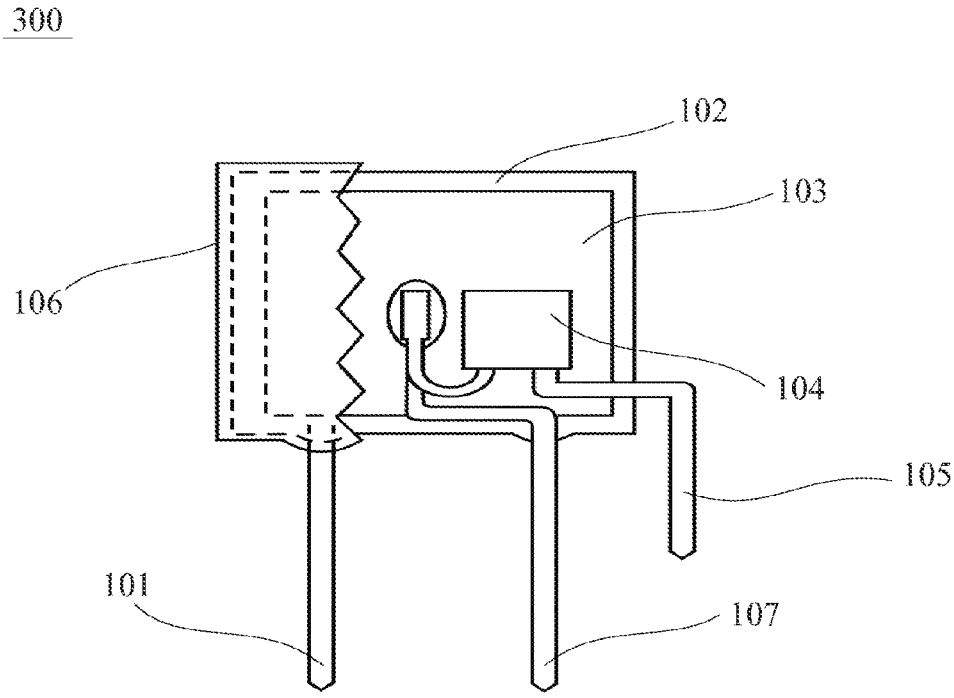
FIG. 6 is a front elevation view of a MOV of a third embodiment according to the present invention.
Figure 7:
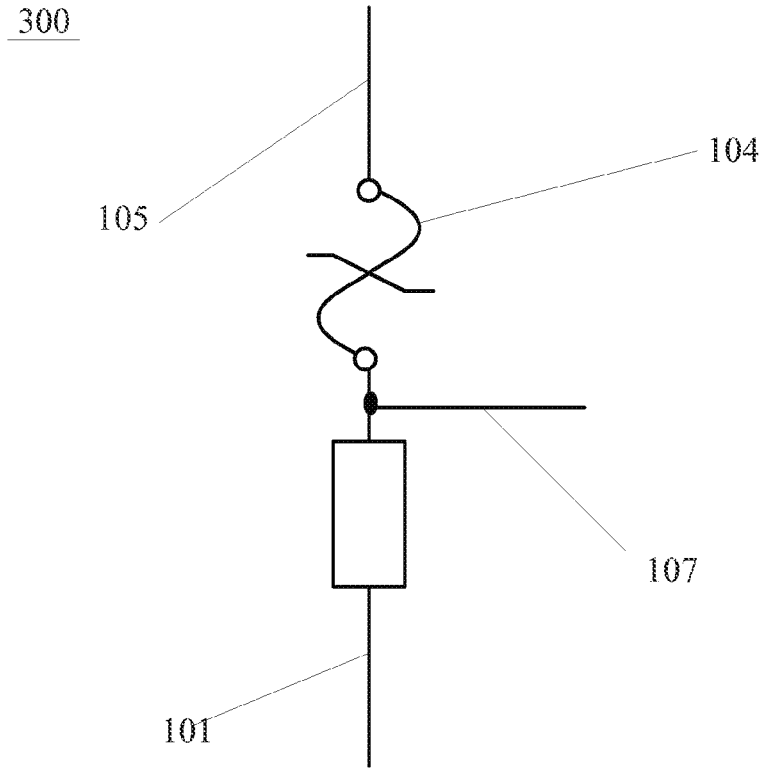
FIG. 7 is a circuit diagram generally showing circuit connection relationships within the MOV of FIG. 6 and FIG. 8.

FIG. 6 and FIG. 7 respectively describe internal structure and circuit connection relationship of a MOV 300 of a third embodiment according to the present invention. The MOV 300 comprises a first lead 101, a MOV body 102, a silver electrode area 103, a thermal cut-off fuse 104, a second lead 105, a coating layer 106 and a third lead 107. Comparing the MOV 300 with the MOV 100 of the first embodiment, the difference is that the MOV 300 further includes the third lead 107. One end of the third lead 107 is electrically connected to the other end of the silver electrode area 103, and the other end of the third lead 107 is adapted to couple with a visual indicator. If the thermal cut-off fuse 104 melts, the third lead 107 is electrically disconnected and the circuit is interrupted, then the visual indicator is activated to monitor the connection of the circuit.

Figure 8:
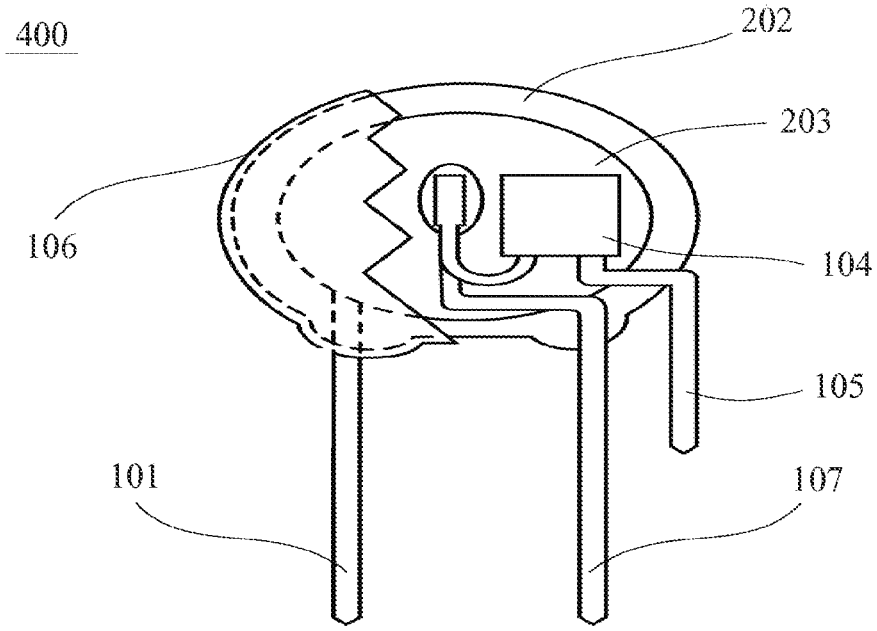
FIG. 8 is a front elevation view of a MOV of a fourth embodiment according to the present invention.

FIG. 8 is a front elevation view of a MOV 400 of a fourth embodiment according to the present invention. The MOV 400 comprises a first lead 101, a MOV body 202, a silver electrode area 203, a thermal cut-off fuse 104, a second lead 105, a coating layer 106 and a third lead 107. Comparing the MOV 400 with the MOV 300 of the third embodiment, the difference is that the MOV body 202 and the silver electrode area 203 are concentric and circular.

It is appreciated that the MOV body and the silver electrode area may be respectively circular or square or assume other shapes.

The foregoing description of the present invention has been presented for purposes of illustration and description. It is not intended to be exhaustive or limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A metal oxide varistor having thermal cut-off function comprising:

a metal oxide varistor body having a first lateral side and a second lateral side, the metal oxide varistor body heating up when exposed to voltage strikes;

a first lead, one end thereof electrically coupled to the first lateral side and the other end opposite to the one end of the first lead adapted to couple to a source of current;

a thermal cut-off fuse comprising a first fuse end and a second fuse end, the thermal cut-off fuse having a predetermined melting point at which the thermal cut-off fuse melts and interrupts current flow therethrough;

a second lead, one end thereof directly and electrically coupled to the first fuse end of the thermal cut-off fuse and the other end opposite to the one end of the second lead adapted to couple to the source of current;

wherein the metal oxide varistor further comprises a silver electrode area, and one end of the silver electrode area is formed on and electrically coupled to the second lateral side, and the other end opposite the one end of the silver electrode area is electrically coupled to the second fuse end of the thermal cut-off fuse, whereby the current is permitted to flow through the first lead, the metal oxide varistor body, the silver electrode area, the thermal cut-off fuse and the second lead when the thermal cut-off fuse is held below the predetermined melting point and the current is interrupted when the thermal cut-off fuse goes above the predetermined melting point and melts due to the heat provided by the metal oxide varistor body, under which case the metal oxide varistor is protected from thermal runway.

2. The metal oxide varistor according to claim 1, further comprising a coating layer coated around the first lead, the metal oxide varistor body, the silver electrode area, the thermal cut-off fuse and the second lead so as to form an outer protection layer.

3. The metal oxide varistor according to claim 1, further comprising a third lead, one end thereof electrically connected to the other end of the silver electrode area, the other end thereof adapted to couple with a visual indicator, and the visual indicator will be activated to monitor circuit connection when the current is interrupted.

4. The metal oxide varistor according to claim 1, wherein the metal oxide varistor body is circular or square.

5. The metal oxide varistor according to claim 1, wherein the silver electrode area is circular or square.

6. The metal oxide varistor according to claim 1, wherein the metal oxide varistor body and the silver electrode area are concentric and circular or square.

* * * * *